US006942203B2

(12) United States Patent
Schroder et al.

(10) Patent No.: US 6,942,203 B2
(45) Date of Patent: Sep. 13, 2005

(54) SPRING MASS DAMPER SYSTEM FOR TURBINE SHROUDS

(75) Inventors: Mark Stewart Schroder, Hendersonville, NC (US); Ronald Ralph Cairo, Greer, SC (US); Christopher Grace, Simpsonville, SC (US); Todd Garrett Wetzel, Niskayuna, NY (US); Kevin Leon Bruce, Greer, SC (US); Andrew William Miller, Lincoln University, PA (US); Ronald Phillip Nimmer, Schenectady, NY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/700,251

(22) Filed: Nov. 4, 2003

(65) Prior Publication Data

US 2005/0093214 A1 May 5, 2005

(51) Int. Cl.[7] ..... F16F 1/18
(52) U.S. Cl. ..... 267/160; 415/135; 415/173.3
(58) Field of Search ..... 267/136, 160; 415/135, 138, 139, 197, 173.1, 173.3, 175, 177, 178, 200

(56) References Cited

U.S. PATENT DOCUMENTS 4,245,954 A * 1/1981 Glenn ..... 415/200
4,621,976 A * 11/1986 Marshall et al. ..... 415/191
5,346,362 A * 9/1994 Bonner et al. ..... 415/191
5,639,211 A * 6/1997 Bintz ..... 415/173.7
6,113,349 A * 9/2000 Bagepalli et al. ..... 415/135
6,726,448 B2 * 4/2004 Farrell et al. ..... 415/173.3

* cited by examiner

*Primary Examiner*—Pam Rodriguez
(74) *Attorney, Agent, or Firm*—Nixon & Vanderhye, P.C./G.E.

(57) ABSTRACT

The damper system includes a ceramic composite shroud in part defining the hot gas path of a turbine and a spring-biased piston and damper block which bears against the backside surface of the shroud to tune the vibratory response of the shroud relative to pressure pulses of the hot gas path in a manner to avoid near or resonant frequency response. The damper block has projections specifically located to bear against the shroud to dampen the frequency response of the shroud and provide a thermal insulating layer between the shroud and the damper block.

21 Claims, 3 Drawing Sheets

SPRING MASS DAMPER SYSTEM FOR TURBINE SHROUDS

BACKGROUND OF THE INVENTION

The present invention relates to a damping system for damping vibration of shrouds surrounding rotating components in a hot gas path of a turbine and particularly relates to a spring mass damping system for interfacing with a ceramic shroud and tuning the shroud to minimize vibratory response from pressure pulses in the hot gas path as each turbine blade passes the individual shroud.

Ceramic matrix composites offer advantages as a material of choice for shrouds in a turbine for interfacing with the hot gas path. The ceramic composites offer high material temperature capability. It will be appreciated that the shrouds are subject to vibration due to the pressure pulses of the hot gases as each blade or bucket passes the shroud. Moreover, because of this proximity to high-speed rotation of the buckets, the vibration may be at or near resonant frequencies and thus require damping to maintain life expectancy during long-term commercial operation of the turbine. Ceramic composites, however, are difficult to attach and have failure mechanisms such as wear, oxidation due to ionic transfer with metal, stress concentration and damage to the ceramic composite when configuring the composite for attachment to the metallic components. Accordingly, there is a need for responding to dynamics-related issues relating to the attachment of ceramic composite shrouds to metallic components of the turbine to minimize adverse modal response.

BRIEF DESCRIPTION OF THE INVENTION

In accordance with an aspect of the present invention, there is provided an attachment mechanism between a ceramic composite shroud and a metallic support structure which utilizes the pressure distribution applied to the shroud, coupled with a loading on the shroud to tune the shroud to minimize damaging vibratory response from pressure pulses of the hot gases as the buckets pass the shrouds. To accomplish the foregoing, and in one aspect thereof, there is provided a spring mass damping system which includes a ceramic composite shroud/damping block, a damper load transfer mechanism and a damping mechanism. The damper block includes at least three projections for engaging the backside of the shroud, thereby spacing the damper block surface from the backside of the shroud, affording a convective insulating layer, and reducing heat load on the damper block. The three projections are specifically located along the damper block to tune the dynamic response of the system. The load transfer mechanism includes a piston having a ball-and-socket coupling with the damper block along with a spring damping mechanism in the socket region of the outer shroud block. The ball-and-socket coupling uses a pin retention system enabling relative movement between the piston and damper block. Local film cooling is also provided to enhance the long-term wear capability of the coupling. The piston engages the spring through a thermally insulating washer and preferably also through a metallic washer, both being encapsulated within a cup supplied with a cooling medium. The cooling medium maintains the temperature of the spring below a temperature limit in order to maintain positive preload on the shroud. Various other aspects of the present invention will become clear from a review of the ensuing description.

In a preferred embodiment according to the present invention, there is provided a damper system for a stage of a turbine comprising a shroud having a first surface defining in part a hot gas path through the turbine, a shroud body for supporting the shroud, a damper block having at least three projections raised from a surface thereof and engaging a backside surface of the shroud opposite the first surface and a damping mechanism carried by the shroud body and connected to the damper block for applying a load to the damper block and the shroud through the engagement of the projections with the backside surface of the shroud thereby damping vibratory movement of the shroud.

In a further preferred embodiment according to the present invention, there is provided a damper system for a stage of a turbine comprising a shroud formed of a ceramic material having a first surface defining in part a hot gas path through the turbine, a shroud body for supporting the shroud, a damper block carried by the shroud body and engaging the shroud, the damper block being formed of a metallic material and a damping mechanism carried by the shroud body and connected to the damper block for applying a load to the damper block and the shroud to dampen vibratory movement of the shroud, the damping mechanism including a spring for applying the load to the damper block.

DETAILED DESCRIPTION OF THE INVENTION

Figure 1:
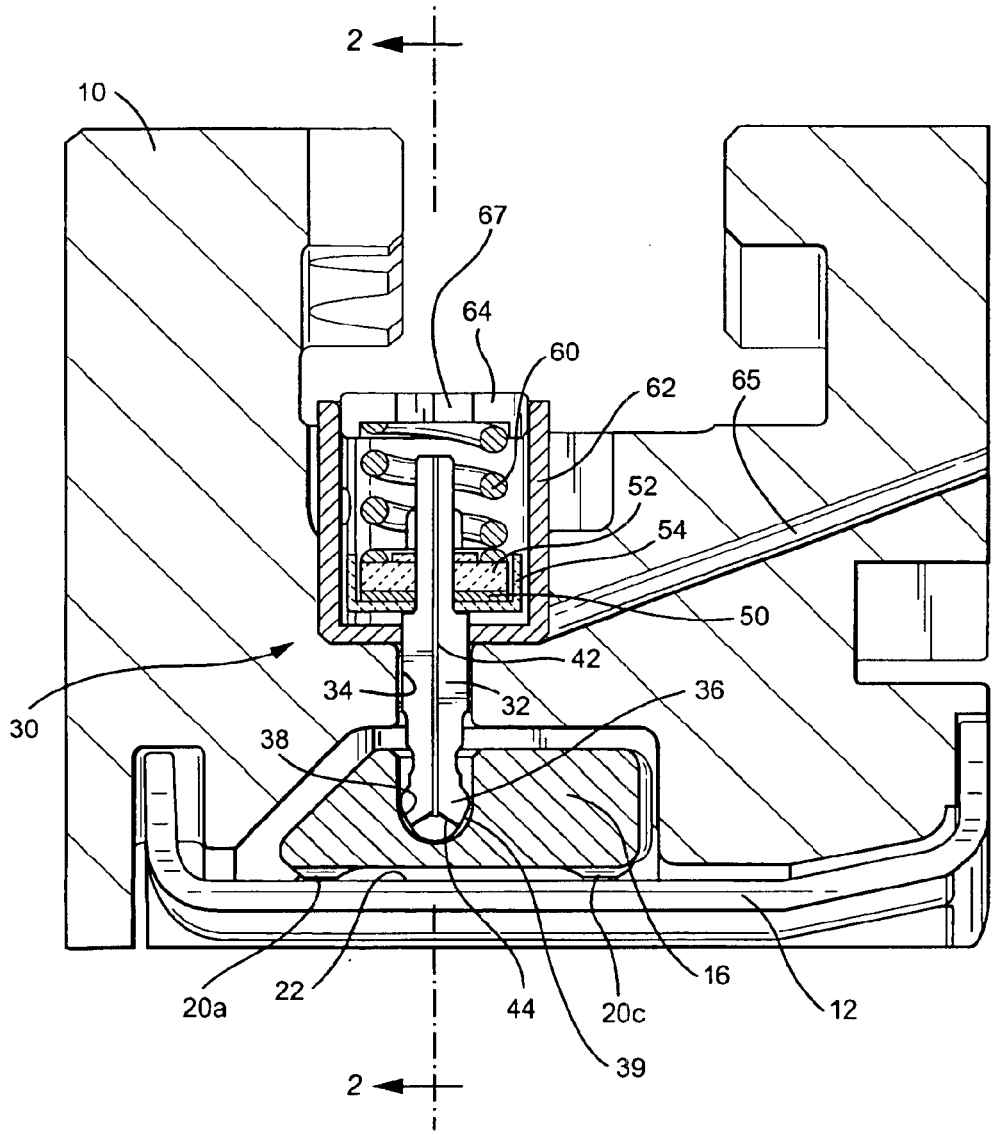
FIG. 1 is a cross-sectional view through an outer shroud block as viewed in a circumferential direction about an axis of the turbine and illustrating a preferred damper system according to the present invention.
Figure 2:
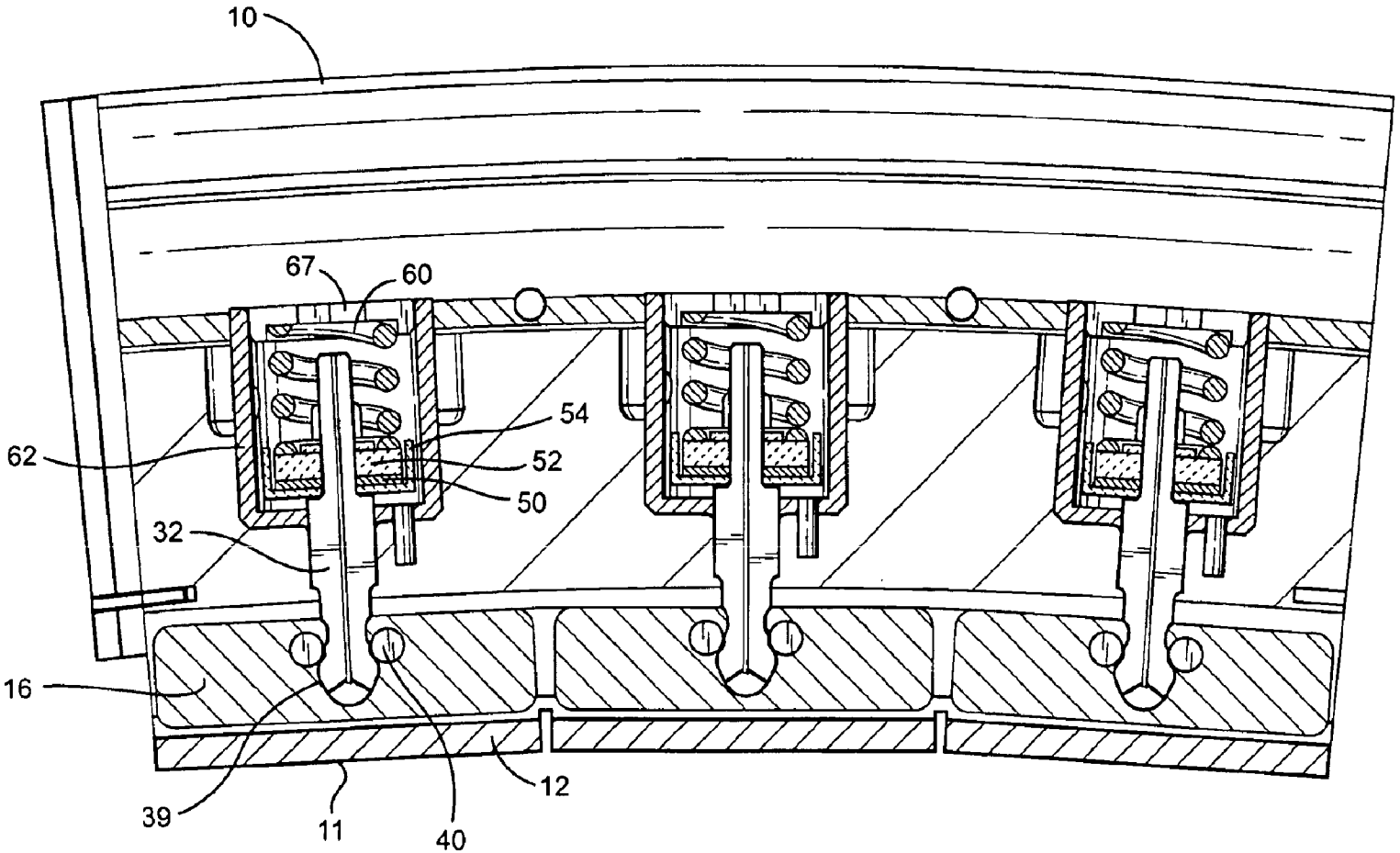
FIG. 2 is a cross-sectional view thereof as viewed in an axial forward direction relative to the hot gas path of the turbine.

Referring now to FIGS. 1 and 2, there is illustrated an outer shroud block or body 10 mounting a plurality of shrouds 12. FIG. 1 is a view in a circumferential direction and FIG. 2 is a view in an axial forward direction opposite to the direction of flow of the hot gas stream through the turbine. As seen from a review of FIG. 2, the shroud block 10 carries preferably three individual shrouds 12. It will be appreciated that a plurality of shroud blocks 10 are disposed in a circumferential array about the turbine axis and mount a plurality of shrouds 12 surrounding and forming a part of the hot gas path flowing through the turbine. The shrouds 12 are formed of a ceramic composite, are secured by bolts, not shown, to the shroud blocks 10, and have a first inner surface 11 (FIG. 2) in contact with the hot gases of the hot gas path.

Figure 3:
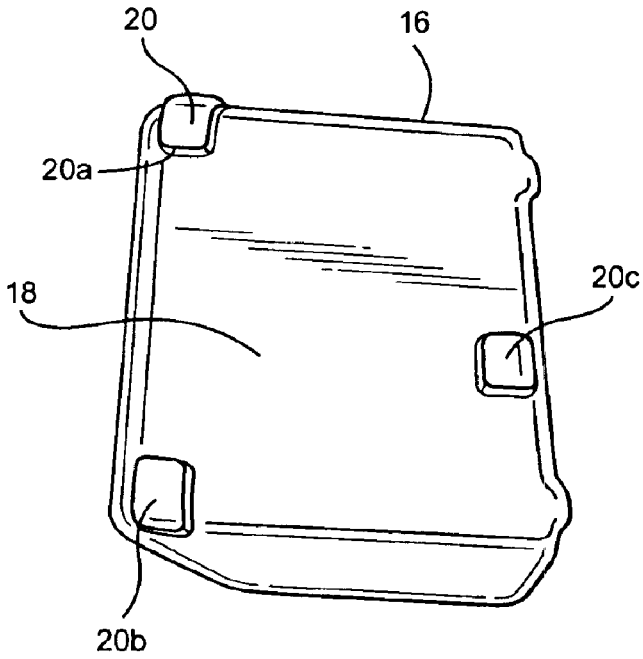
FIG. 3 is a perspective view illustrating the interior surface of a damper block with projections for engaging the backside of the shroud.

The damper system of the present invention includes a damper block/shroud interface, a damper load transfer mechanism and a damping mechanism. The damper block/shroud interface includes a damper block 16 formed of a metallic material, e.g., PM2000, which is a superalloy material having high temperature use limits of up to 2200° F. As illustrated in FIGS. 1 and 3, the radially inwardly facing surface 18 (FIG. 3) of the damper block 16 includes at least three projections 20 which engage a backside surface 22 (FIG. 1) of the shroud 12. Projections 20 are sized to distribute sufficient load to the shroud 12, while minimizing susceptibility to wear and binding between the shroud 12 and damper block 16. The location of the projections 20 are dependent upon the desired system dynamic response which is determined by system natural frequency vibratory response testing and modal analysis. Consequently, the locations of the projections 20 are predetermined.

Two of the projections 20*a* and 20*b* are located along the forward edge of the damper block 16 and adjacent the opposite sides thereof. Consequently, the projections 20*a* and 20*b* are symmetrically located along the forward edge of the damper block 16 relative to the sides. The remaining projection 20*c* is located adjacent the rear edge of the damper block 16 and toward one side thereof. Thus, the rear projection 20*c* is located along the rear edge of block 16 and asymmetrically relative to the sides of the damper block 16. It will be appreciated also that with this configuration, the projections 20 provide a substantial insulating space, i.e., a convective insulating layer, between the damper block 16 and the backside of the shroud 12, which reduces the heat load on the damper block. The projections 20 also compensate for the surface roughness variation commonly associated with ceramic composite shroud surfaces.

The damper load transfer mechanism, generally designated 30, includes a piston assembly having a piston 32 which passes through an aperture 34 formed in the shroud block 10. The radially inner or distal end of the piston 32 terminates in a ball 36 received within a complementary socket 38 formed in the damper block 16 thereby forming a ball-and-socket coupling 39. As best illustrated in FIG. 2, the sides of the piston spaced back from the ball 36 are of lesser diameter than the ball and pins 40 are secured, for example, by welding, to the damper block 16 along opposite sides of the piston to retain the coupling between the damper block 16 and the piston 32. The coupling enables relative movement between the piston 32 and block 16.

Figure 4:
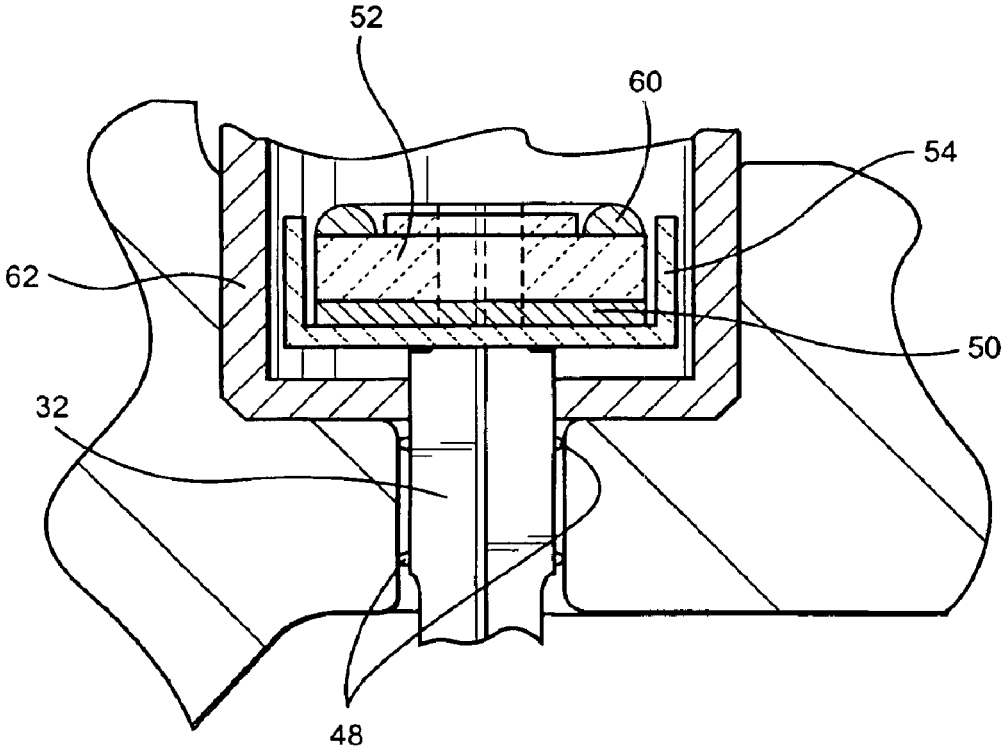
FIG. 4 is an enlarged cross-sectional view illustrating portions of the damper load transfer mechanism and damping mechanism.

A central cooling passage 42 is formed axially along the piston, terminating in a pair of film-cooling holes 44 for providing a cooling medium, e.g., compressor discharge air, into the ball-and-socket coupling. The cooling medium, e.g., compressor discharge air, is supplied from a source radially outwardly of the damper block 10 through the damping mechanism described below. As best illustrated in FIG. 4, the sides of the piston are provided with at least a pair of radially outwardly projecting, axially spaced lands 48. The lands 48 reduce the potential for the shaft to bind with the aperture of the damper block 10 due to oxidation and/or wear during long-term continuous operation.

The damper load transfer mechanism also includes superposed metallic and thermally insulated washers 50 and 52, respectively. The washers are disposed in a cup 54 carried by the piston 32. The metallic washer 50 provides a support for the thermally insulating washer 52, which preferably is formed of a monolithic ceramic silicone nitride. The thermally insulative washer 52 blocks the conductive heat path of the piston via contact with the damper block 12.

The damping mechanism includes a spring 60. The spring is pre-conditioned at temperature and load prior to assembly as a means to ensure consistency in structural compliance. The spring 60 is mounted within a cup-shaped housing 62 formed along the backside of the shroud block 10. The spring is preloaded to engage at one end the insulative washer 52 to bias the piston 32 radially inwardly. The opposite end of spring 60 engages a cap 64 secured, for example, by threads to the housing 62. The cap 64 has a central opening or passage 67 enabling cooling flow from compressor discharge air to flow within the housing to maintain the temperature of the spring below a predetermined temperature. Thus, the spring is made from low-temperature metal alloys to maintain a positive preload on the piston and therefore is kept below a predetermined specific temperature limit. The cooling medium is also supplied to the cooling passage 42 and the film-cooling holes 44 to cool the ball-and-socket coupling. A passageway 65 is provided to exhaust the spent cooling medium. It will be appreciated that the metallic washer 50 retained by the cup 54 ensures spring retention and preload in the event of a fracture of the insulative washer 52.

It will be appreciated that in operation, the spring 60 of the damping mechanism maintains a radial inwardly directed force on the piston 32 and hence on the damper block 16. The damper block 16, in turn, bears against the backside surface 22 of the shroud 12 to dampen vibration and particularly to avoid vibratory response at or near resonant frequencies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What as claimed is:

1. A damper system for a stage of a turbine comprising:

a shroud having a first surface defining in part a hot gas path through the turbine;

a shroud body for supporting said shroud;

a damper block having at least three projections raised from a surface thereof and engaging a backside surface of said shroud opposite said first surface; and a damping mechanism carried by said shroud body and connected to said damper block for applying a load to said damper block and said shroud through the engagement of the projections with the backside surface of the shroud thereby damping vibratory movement of said shroud.

2. A system according to claim 1 wherein two of said projections lie adjacent a forward edge of said damper block surface in an upstream direction relative to the direction of flow of hot gas through the turbine and a third projection of said at least three projections lies adjacent a rearward edge of said damper block surface intermediate sides of said damper block.

3. A system according to claim 2 wherein said two projections are symmetrically located relative to opposite sides of said damper block and said third projection is asymmetrically located relative to said opposite sides.

4. A system according to claim 1 wherein the damper block surface is spaced from the backside surface of the shroud by said projections to provide a thermal insulating layer between said shroud and said damper block.

5. A system according to claim 1 wherein said shroud is formed of a ceramic material and said damper block is formed of a metallic material.

6. A system according to claim 1 wherein said damping mechanism includes a spring and a piston biased by said spring to apply the load to said damper block.

7. A system according to claim 6 including a housing for said spring in communication with a cooling medium for cooling the spring.

8. A system according to claim 6 wherein said piston and said damper block are secured to one another by a ball-and-socket coupling and at least one cooling passage along said piston for supplying a cooling medium into the ball-and-socket coupling.

9. A system according to claim 8 wherein the piston includes a plurality of film-cooling holes in communication with said one cooling passage for film-cooling the socket.

10. A system according to claim 6 wherein said piston passes through an aperture in said shroud body and includes at least a pair of lands spaced from one another along a surface of the piston passing through the aperture to minimize binding of the piston and shroud body due to oxidation and/or wear.

11. A system according to claim 6 wherein said piston and said damper block have a ball and socket, respectively, forming a ball-and-socket coupling therebetween, and a pair of pins secured to said damper block to engage the ball of the piston and the socket of the damper block to secure the piston and damper block to one another.

12. A system according to claim 6 including a washer about the piston and engaged by the spring, said washer being formed of a thermally insulating material.

13. A system according to claim 6 including a cup-shaped housing for the spring, a cap at one end of said housing and one end of said spring bearing against said cap, an annular thermally insulating washer between an opposite end of the spring and a base of the cup-shaped housing and a cooling passage opening into said housing for cooling the spring.

14. A system according to claim 1 wherein said shroud in part surrounds components of the gas turbine rotating in said hot gas path, said damper block and said damping mechanism tuning the shroud to minimize vibratory response from pressure pulses in the hot gas path as each component rotates past said shroud.

15. A damper system for a stage of a turbine comprising:

a shroud formed of a ceramic material having a first surface defining in part a hot gas path through the turbine;

a shroud body for supporting said shroud;

a damper block carried by said shroud body and engaging said shroud, said damper block being formed of a metallic material; and a damping mechanism carried by said shroud body and connected to said damper block for applying a load to said damper block and said shroud to dampen vibratory movement of said shroud, said damping mechanism including a spring for applying the load to the damper block, said damping mechanism including a piston, said damper block being secured to said piston by a ball-and-socket coupling and at least one cooling passage along said piston for supplying a cooling medium into the ball-and-socket coupling.

16. A system according to claim 15 including a housing for said spring in communication with a cooling medium for cooling the spring.

17. A system according to claim 15 wherein the piston includes a plurality of film-cooling holes for film-cooling the socket.

18. A system according to claim 15 wherein said piston passes through an aperture in said shroud body and includes at least a pair of lands spaced from one another along a surface of the piston passing through the aperture to minimize binding of the piston and shroud body due to oxidation and/or wear.

19. A system according to claim 15 including a washer about the piston and engaged by the spring, said washer being formed of a thermally insulating material.

20. A system according to claim 15 including a cup-shaped housing for the spring, a cap at one end of said housing and one end of said spring bearing against said cap, an annular thermally insulating washer between an opposite end of the spring and said piston, and a cooling passage opening into said housing for cooling the spring.

21. A system according to claim 15 wherein said shroud in part surrounds components of the gas turbine rotating in said hot gas path, said damper block and said damping mechanism tuning the shroud to minimize vibratory response from pressure pulses in the hot gas path as each component rotates past said shroud.

* * * * *

UNITED STATES PATENT AND TRADEMARK OFFICE

CERTIFICATE OF CORRECTION

PATENT NO. : 6,942,203 B2
APPLICATION NO. : 10/700251
DATED : September 13, 2005
INVENTOR(S) : Schroder et al.

It is certified that error appears in the above-identified patent and that said Letters Patent is hereby corrected as shown below:

In column 1 immediately below the title insert:

--The Government of the United Sates of America has rights in this invention pursuant to contract No. DE-FC02-00CH11047.--

Signed and Sealed this

Twenty-second Day of May, 2007

JON W. DUDAS
*Director of the United States Patent and Trademark Office*